US005609923A

United States Patent [19]

Clarke

[11] Patent Number: 5,609,923

[45] Date of Patent: Mar. 11, 1997

[54] METHOD OF CURTAIN COATING A MOVING SUPPORT WHEREIN THE MAXIMUM PRACTICAL COATING SPEED IS INCREASED

[75] Inventor: Andrew Clarke, Berkhamsted, United Kingdom

[73] Assignee: Eastman Kodak Company, Rochester, N.Y.

[21] Appl. No.: 600,709

[22] Filed: Feb. 13, 1996

[30] Foreign Application Priority Data

Feb. 25, 1995 [GB] United Kingdom ..... 95003849

[51] Int. Cl.[6] ..... B05D 1/30

[52] U.S. Cl. ..... 427/458; 427/470; 427/532; 427/535; 427/536; 427/540; 427/420

[58] Field of Search ..... 427/420, 470, 427/458, 532, 535, 536, 540

[56] References Cited

U.S. PATENT DOCUMENTS

| | | | |
|---|---|---|---|
| 4,457,256 | 7/1984 | Kisler et al. | 118/621 |
| 5,122,386 | 6/1992 | Yoshida | 427/13 |
| 5,340,616 | 8/1994 | Amano et al. | 427/458 |

FOREIGN PATENT DOCUMENTS

| | | |
|---|---|---|
| 0386796A2 | 3/1990 | European Pat. Off. . |
| 0440279A1 | 1/1991 | European Pat. Off. . |
| 0464775A3 | 7/1991 | European Pat. Off. . |
| 0563086B1 | 12/1991 | European Pat. Off. . |
| 0530752A1 | 9/1992 | European Pat. Off. . |
| WO89/05477 | 6/1989 | WIPO . |
| WO92/11572 | 7/1992 | WIPO . |

*Primary Examiner*—Katherine A. Bareford
*Attorney, Agent, or Firm*—Arthur H. Rosenstein

[57] ABSTRACT

Curtain coating processes arc well known wherein a composition is coated on to a moving support. However, the maximum coating speeds in such processes are severely limited at high curtain flow rates by the formation of a region metastable to air-entrainment. Described herein is a method which enhances the maximum coating speed at high flow tales by the application of small levels of voltages, typically below 400 V, to the moving support. Progressive suppression of the metastable region is obtained as the, voltage level is increased. All levels of voltage up to 400 V give a degree of removal of the metastable region, and therefore will enhance the maximum practical coating speed. Lower levels of voltage may also be used in conjunction with forward application angles to selectively enhance the maximum practical coating speed for a given laydown.

10 Claims, 3 Drawing Sheets

METHOD OF CURTAIN COATING A MOVING SUPPORT WHEREIN THE MAXIMUM PRACTICAL COATING SPEED IS INCREASED

FIELD OF THE INVENTION

The present invention relates to improvements in or relating to curtain coating and is more particularly, although not exclusively, concerned with the production of photographic products using curtain coating techniques.

BACKGROUND OF THE INVENTION

In bead coating techniques, a bead coating applicator and the moving support on to which the bead is to be coated are in close proximity in a coating zone. Bead formation needs to be controlled if a stable process is to be obtained which permits the use of a wide latitude of coating speeds, layer viscosities and layer thicknesses. Control and stabilization of the bead formation is achieved, first, by using a pressure differential (suction) across the bead at the application locus, and secondly, by applying an electrostatic charge differential just prior to the application locus. Both a pressure differential and an electrostatic charge serve to hold the bead within the coating zone as both these act towards the support aiding the stabilization of the bead and maintaining it in wetting contact with the moving support.

As mentioned above, it is known to use electrostatic fields to improve the uniformity of coatings produced using bead coating techniques. In one known arrangement, a support or backing roller is spaced from a bead coating applicator to form a coating gap therebetween. A high voltage power supply is connected across the backing roller and the bead coating applicator providing a DC voltage of several kilovolts, typically 3 kV, across the coating gap. This DC voltage produces an electrostatic field in the coating gap between the backing roller and the grounded applicator, the backing roller being at a high potential. As a support to be coated is moved through the coating gap, it becomes polarized due to the presence of the electrostatic field thereby producing a given orientation of the dipoles in the moving support. The polarization of the support causes fluid flowing from the applicator into the coating gap to be attracted towards the moving support and to be uniformly deposited thereon.

The actual magnitude and polarity of the electrical potential which needs to be applied to the moving support to generate the polarization thereof is determined by the type of material to be coated, that is, the material of the moving support, and the type of composition to be coated on to the moving support. In some cases, the potential of the coating applicator may be required to be greater or less than ground potential at which it is normally maintained.

However, using voltages of the order of 3 kV or more, as is the case with this arrangement, may create problems with the coating. For example, sparks can be generated making the arrangement unsuitable for use in explosive or volatile environments. In other instances, holes may be produced in the moving support which is to be coated. Furthermore, short circuits or low impedance paths may appear across the coating gap as a result of pinholes existing in the moving support which produces variations in the uniformity of the material being coated.

EP-A-0 055 983 describes an arrangement for applying a bead coating to a moving support which is similar to that described above, namely, that a support or backing roller is spaced from a bead coating applicator to form a coating gap therebetween. However, in this case, the electrostatic charge is not applied to the moving support by an electrostatic field formed in the coating gap. The electrostatic charge is applied to the moving support prior to it reaching the coating gap. This is achieved by generating an electrostatic field on and in the moving support a considerable distance away from the coating gap. The electrostatic field may be generated either using a backing roller and a conductive bristle brush arrangement or using a corona-type arrangement. In both cases, the moving support passes through the electrostatic field produced to receive its electrostatic charge which provides the orientation of the dipoles in the moving support to which the coating material is attracted.

When the backing roller-conductive bristle brush arrangement is used, a relatively intense electrostatic field is established between the free ends of the bristles of the conductive bristle brush and the backing roller with a relatively low voltage. This lower voltage advantageously prevents the occurrence of the problems mentioned above.

Curtain coating techniques differ substantially from bead coating techniques as a freely-falling curtain is formed from a slide hopper which is not in close proximity to the application locus on the moving support. As a result, curtain coating techniques have many advantages over bead coating techniques. In curtain coating techniques, no bead is ever formed and the mechanism of the coating action is distinctly different. For example, the curtain is free-falling and impinges on the moving support with considerable momentum to provide a sufficient force to stabilize the application locus and ensure a uniform wetting line on the moving support. The required momentum is obtained by appropriate selection of the curtain flow rate and the height of free fall.

Other differences are apparent between bead and curtain coating techniques. The effects of coating variables, such as viscosity of the coating composition and flow rate per unit width of coating, are usually completely different in bead and curtain coating techniques.

With bead coming, in order to increase coating speed while retaining coating uniformity, the viscosity of the bottom layer must be reduced thereby increasing the wet coverage of that layer.

However, when curtain coating at high speeds, a high flow rate per unit width can often result in 'puddling' of the coating on the support. This commonly occurs when the curtain velocity at the application locus on the support is greater than the velocity of the support being coated. 'Puddling' can also occur when the support velocity is greater than the curtain velocity if the momentum of the curtain at the coating application locus is too high. In either case, 'puddling' leads to non-uniformities in coating. In contrast to bead coating, these types of coating failures can often be avoided by increasing the viscosity of the coating composition or by lowering the wet coverage of the bottom layer.

EP-B-0 390 774 discloses a method of curtain coating in which it is possible to operate at high coating speeds, with the use of an appropriate level of electrostatic charge, with a particular set of operating parameters such as support smoothness, flow rate, coating composition viscosity and curtain height. The support is moved through the coating zone at a speed of at least 250 $cms^{-1}$ and a level of electrostatic charge is applied to the support in accordance with the speed of the support such that the ratio of the magnitude of the charge at any point on the surface of the support to the speed of the support is at least 1:1, the charge being expressed in V and the speed in $cms^{-1}$.

EP-A-0 530 752 discloses a coating method in which the phenomenon of air-entrainment is prevented so as to increase the coating speed obtainable during the coating process. The method involves two steps, namely, heating the moving support to a temperature between 35° C. and 45° C. prior to being coated, and applying an electrostatic charge thereto, prior to the application of the coating material. The electrostatic charge can be applied directly to the moving support using a corona discharge electrode or indirectly by applying a high voltage to a backing roller, the backing roller supporting the moving support as the coating is applied. In both cases, the voltages used are in the range of 0.5 to 2 kV.

EP-A-0 563 308 discloses a curtain coating method in which a forward application angle for the freely-falling curtain is utilized to increase the coating speeds obtained. (Application angle is defined as the slope angle of the support at the point of impingement of the freely-falling curtain and a substantially vertical curtain, measured as a declination from the horizontal in the direction of coating.) A freely-falling curtain of the composition to be coated on to a support is directed on to the support as it is moved through a coating zone. The curtain and support are positioned relative to one another so that the curtain impinges on the support in the coating zone with a forward application angle between the curtain and the uncoated support.

Coating speeds in curtain coating are severely limited at high curtain flow rates by the formation of a metastable region. The metastable region is discussed and illustrated in EP-A-0 563 308 and EP-A-0 563 086. It is understood that when curtain coating at moderate to high flow rates, the coating speed at which air-entrainment commences is higher than that at which it clears. At intermediate coating speeds, coating is metastable with respect to any disturbance which may lead to air-entrainment. For practical purposes therefore, these intermediate coating speeds cannot be utilized.

As described in EP-A-0 563 3(5)8, forward application angles in curtain coating allow an increase in the maximum practical coating speed by suppressing the metastable region. The appropriate application angle to give the optimum improvement is dependent on the product being coated, e.g. the wet thickness of the product.

As discussed above, it is well known to use electrostatic charges in curtain coating techniques. This is generally referred to as 'polar charge assist'. The effect of 'polar charge assist' is to increase the maximum practical coating speed attainable before air-entrainment disrupts the coating. To date it has been understood that significant increases in coating speed are only achievable with reasonably high voltages. However, with voltage levels above about 1200 V, corona discharge at roller nips can fog sensitized photographic products. Moreover, the use of voltages around or above 500 V may also lead to coating defects.

In addition, defects clue to local variations in the electrostatic charge on the support may also result in non-uniform coatings. One of these defects is charge induced mottle.

Another such defect is due to patterns on the surfaces of rollers utilized during the coating process, for example, at the rollers employed at the charging point where the electrostatic charge is applied to the moving support, at the roller over which the support passes at the coating point, and at the face rollers located between the charging point and the coating point. The patterns on the rollers produce a variable gap between the surface of the rollers and the support. This variable gap changes the capacitance of the support, and hence the charge thereon, which causes non-uniform electrostatic fields producing non-uniformities in the resulting coating.

SUMMARY OF THE INVENTION

It is therefore an object of the present invention to provide an improved method for curtain coating in which the coating window and hence the maximum practical coating speed is increased, using electrostatic techniques which method does not suffer from the problems associated with the prior art techniques discussed above.

In accordance with one aspect of the present invention, there is provided a method of curtain coating a composition on to a moving support in which the maximum practical coating speed is increased, the method being characterized in that an electrostatic voltage is applied to the support, the ratio of the magnitude of the electrostatic voltage at any point on the support to the coating speed being less than 1:1, the voltage being expressed in V and the coating speed in $cms^{-1}$.

In accordance with another aspect of the present invention, there is provided a method of curtain coating a composition on to a moving support in which the maximum practical coating speed is increased, the method being characterized by the application of an electrostatic voltage to the support which is less than 500 V.

The term 'electrostatic voltage' is defined as the voltage, measured across the support, at the coating point, which corresponds to the electrostatic charge on the moving support. The electrostatic charge may be applied prior to the coating point or at the coating point itself by a backing roller. This electrostatic voltage provides the 'polar charge assist'.

Additionally, forward application angles can be utilized to further enhance the maximum practical coating speed.

Advantageously, it has been shown that the application of low levels of electrostatic voltage to the moving support can significantly enhanced the maximum practical coating speed at high flow rates. This unexpected enhancement is effected by progressive suppression of the metastable region as the electrostatic voltage is increased. In this way, the maximum practical coating speed for a given product may be imp roved significantly without incurring the usual defect penalties of electrostatic techniques such as those described above. It has been found that all low levels of electrostatic voltage give a degree of removal of the metastable region, enhancing the maximum practical coating speed. However, the use of electrostatic voltages below 500 V are preferred as these voltages result in far less of the defects and problems discussed above.

Lower levels of electrostatic voltage may also be used in conjunction with forward application angles to selectively enhance the maximum practical coating speed for a given flow rate.

BRIEF DESCRIPTION OF THE DRAWINGS

For a better understanding of the present invention, reference will now be made, by way of example only, to the accompanying drawings in which.

DETAILED DESCRIPTION OF THE INVENTION

In accordance with the present invention, it is shown that the use of low levels of electrostatic voltages progressively suppresses the metastable region in curtain coating. It is therefore possible to utilize higher coating speeds at moderate to high flow rates. In particular, gains in the maximum practical coating speed are progressively achieved such that even at voltages less than 400 V there is an improvement in the maximum practical coating speed.

Furthermore, the metastable region can also be suppressed by judiciously choosing an appropriate forward application angle together with a small electrostatic voltage (for example, 400 V), to get the highest practical coating speed for a given flow rate of a particular coating composition.

In effect, there will exist an optimum condition combining forward application angles and 'polar charge assist', thereby increasing the practical coating speed for a given flow rate to produce a desired product laydown. Thus, it may be the case that the optimum application angle is chosen in dependence on both the product laydown and the electrostatic voltage employed.

Figure 1:
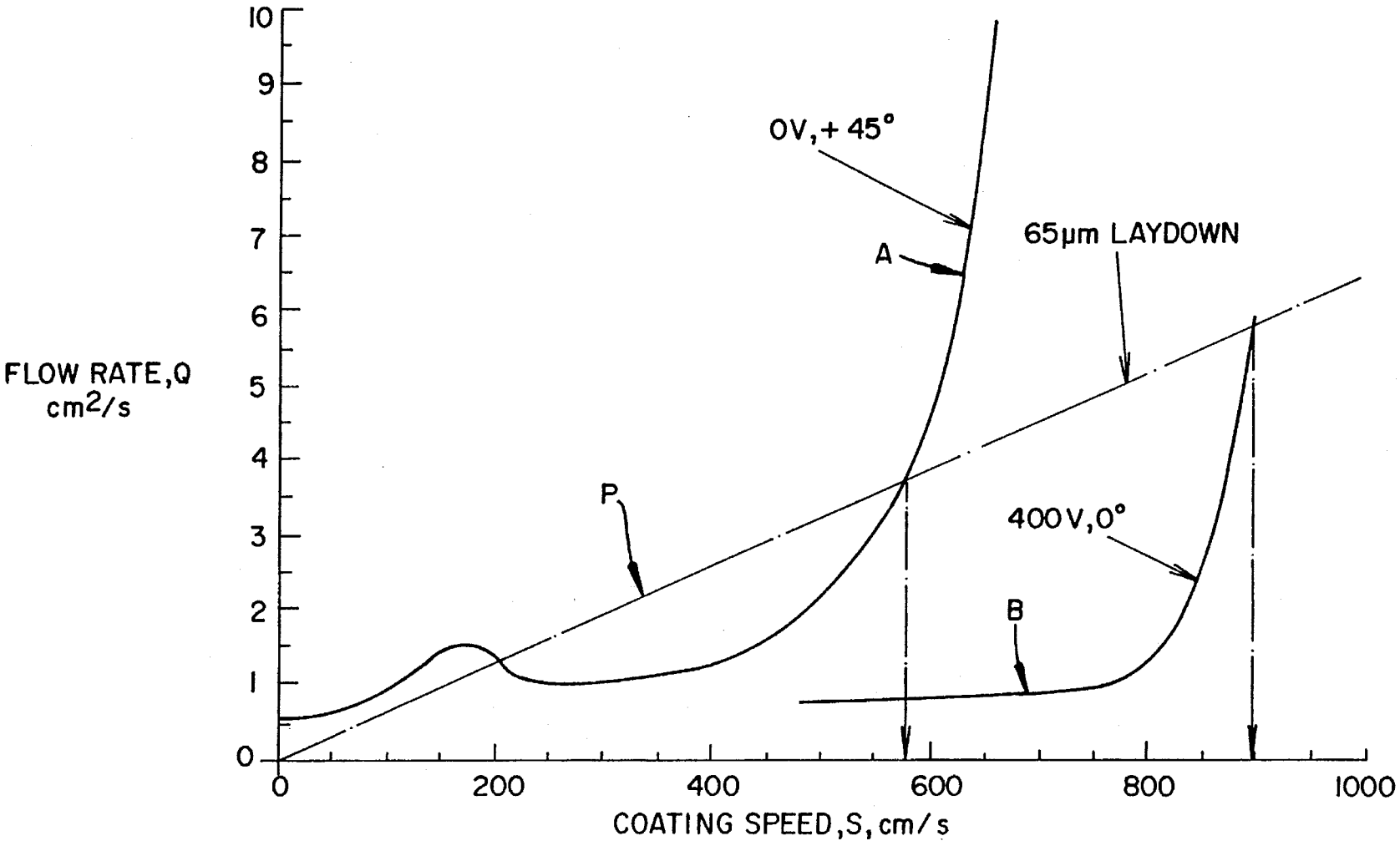
FIG. 1 illustrates a coating map on which is shown a line which represents a laydown of 65 mm showing the effect of 'polar charge assist' in accordance with the present invention.
Figure 2:
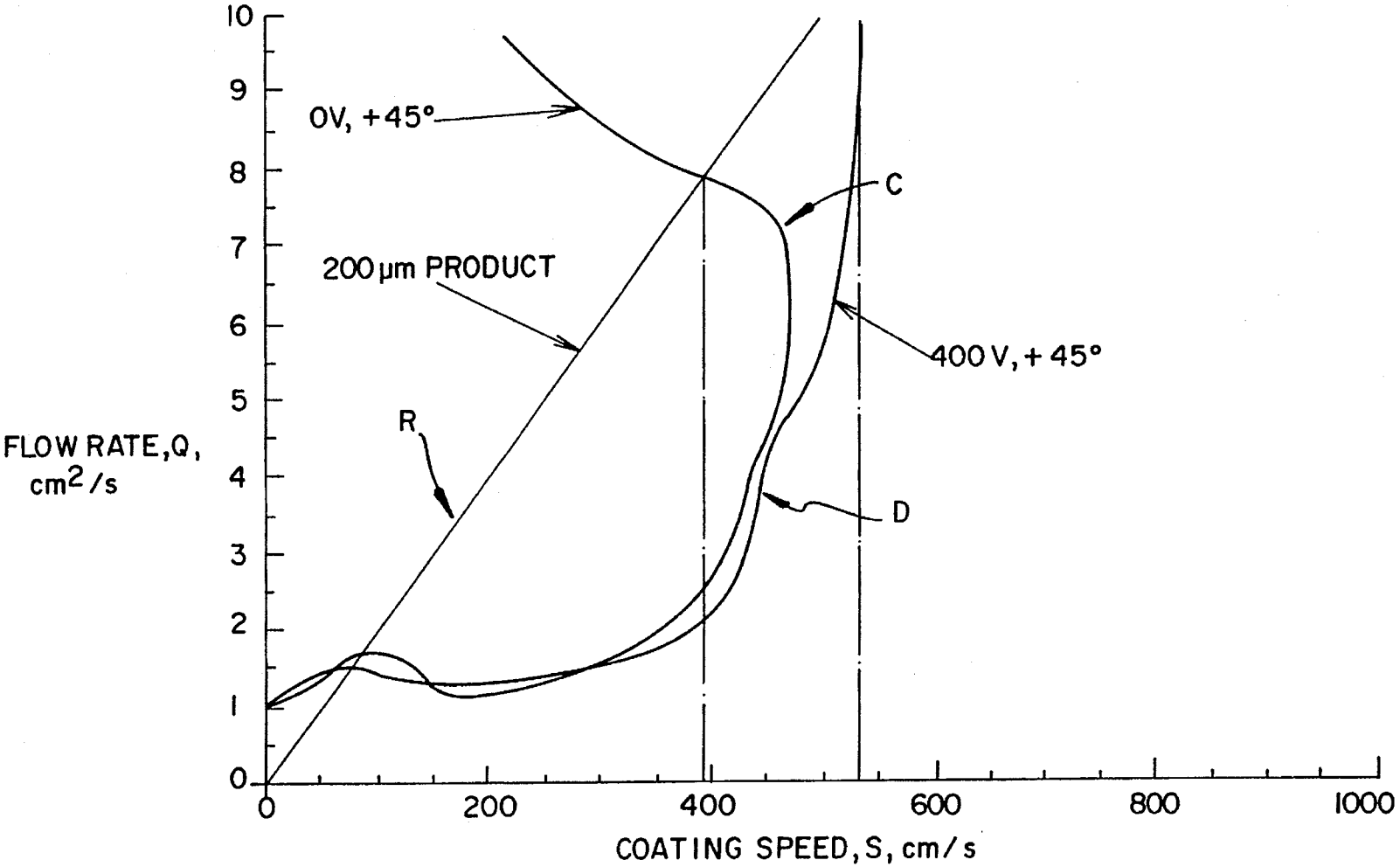
FIG. 2 illustrates a coating map on which is shown a line which represents a laydown of 200 mm showing the effect of 'polar charge assist' for a 45° forward application angle in accordance with the present invention.
Figure 3:
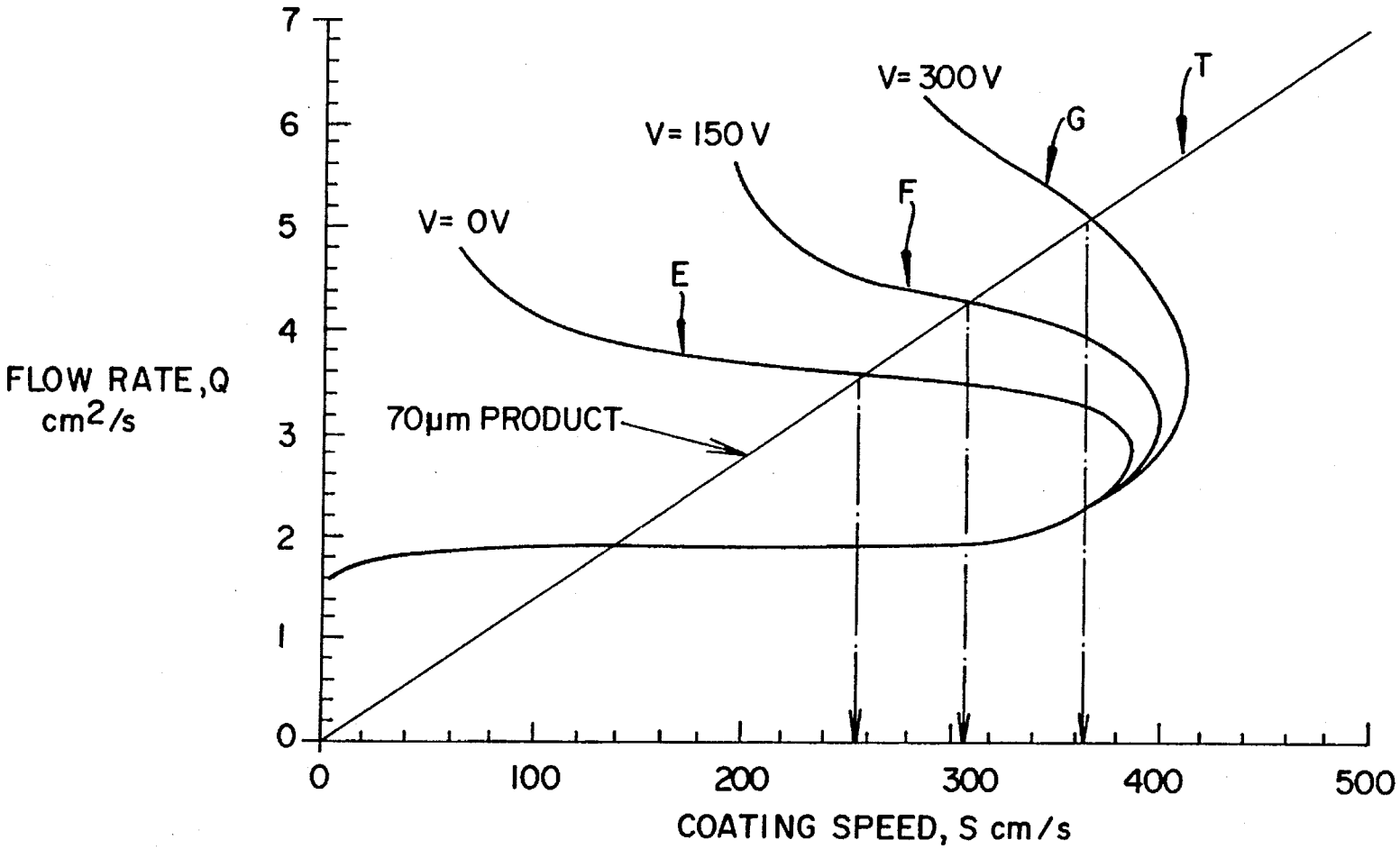
FIG. 3 illustrates a coating map on which is shown a line which represents a laydown of 70 mm showing the effect of 'polar charge assist' for a 0° application angle in accordance with the present invention.

FIGS. 1 to 3 are coating maps which illustrate the range of flow rates and coating speeds over which practical coating can be achieved. A coating map is a plot of coating speed. S ($cms^{-1}$), against flow rate per unit width, Q ($cm^2s^{-1}$), of the coating hopper. The solid lines, which are not linear, are the boundaries at which air-entrainment clears on reducing coating speed. (As discussed previously, the onset of air-entrainment occurs at a higher coating speed than that at which it clears.)

In each case, the practical coating region is to the left of the solid line. To the right of the line, the coating either is metastable or suffers from air-entrainment.

Lines of constant laydown (constant thickness) are also indicated, each corresponding to the flow rate and coating speed relationship which gives a constant laydown for a particular product. The arrows show the maximum practical coating speed for the laydown, application angle and electrostatic voltage indicated.

In each of the examples described below, the support on to which the composition was coated comprised a polyethylene terephthalate material (PET), 100 mm thief, having a conventional subbing layer to promote adhesion between the coating to be deposited and the support.

EXAMPLE 1

The constant laydown line, P, for a coating having a wet thickness of 65 mm is shown in FIG. 1. The composition, which was coated in this example, was a 15% aqueous gelatin solution with a 0.1% conventional surfactant coating aid. A curtain height of 25.4 cm was used to produce the coating map for this product for an application angle of 45° with no 'polar charge assist', as indicated by ling A, and for an application angle of 0° with an electrostatic voltage of 400 V, as indicated by line B.

When only a forward application angle is used with no 'polar charge assist', line A, the maximum coating speed was around 580$cms^{-1}$ (determined from the coating map at the point where product ling P intercepts the coating map, line A).

However, a maximum practical coating speed of around 850$cms^{-1}$ was obtained when an electrostatic voltage of 400 V was used with a 0° application angle.

EXAMPLE 2

The constant laydown line, R, for a coating having a wet thickness of 200 mm is shown in FIG. 2. The composition, which was coated in this example, was a 15% aqueous gelatin solution. A curtain height of 10.2 cm was used at a forward application angle of 45°. As shown by line C, the maximum practical coating speed was around 400 $cms^{-1}$ where no 'polar charge assist' was used.

However, when an electrostatic voltage of 400 V was used, with the same application angle, a maximum coating speed around 525 $cms^{-1}$ was obtained, line D.

EXAMPLE 3

The constant laydown line, T, for a coating having a wet thickness of 70 mm is shown in FIG. 3. The same composition as was used for Example 2 was used in this example. A curtain height of 3 cm was used at an application angle of 0°.

As shown from line E, with no 'polar charge assist', the maximum coating speed was around 250 $cms^{-1}$. As the electrostatic voltage was increased to 150 V, line F, the maximum practical coating speed increased to around 300 $cms^{-1}$, and as the electrostatic voltage was increased further to 300 V, line G, the maximum practical coating speed increased to around 360 $cms^{-1}$ It will be readily appreciated that the present invention is distinguished over the disclosures of the prior art in that:

a) electrostatic voltages of lower magnitude than 500 V, with a preferred maximum of 400 V, are utilized to increase the maximum practical coating speed; and b) there is no requirement to 'match' electrostatic voltage with coating speeds in accordance with a predetermined ratio as required by EP-B-0 390 774.

In the case of b) above, it can be seen from the Examples that the electrostatic voltage is numerically less than the maximum practical coating speed obtained for a given product laydown, that is, the level of electrostatic voltage applied to the support does not satisfy the ratio of the magnitude of the electrostatic voltage at any point on the surface of the support to the speed of the support being at least 1:1, the voltage being expressed in V and the speed in $cms^{-1}$ In accordance with the present invention, this ratio is considerably less than 1:1.

Although the Examples described above use electrostatic voltages of 400 V or less, it will be readily appreciated that higher voltages could also be used to achieve an electrostatic voltage to coating speed ratio of less than 1:1. Naturally, this may require a 'trade off' between increased coating speed and the quality of the coating.

Naturally, curtain heights and application angles need to be varied in accordance with the laydowns required to manufacture photographic products as is well known in the art. The present invention enhances the maximum practical coating speed independently of these variables.

Techniques for generating the electrostatic voltage which results in the 'polar charge assist' are well known. Generally, these techniques all induce a charge on the support which provides the required orientation of the dipoles within the support material to attract the composition being coated.

Corona discharge techniques can be used to charge the support. Alternatively, charge can be transferred to the support using a charged coating roller or other roller over which the support passed prior to attaining the coating zone. A bristle brush arrangement as described in EP-A-0 055 983 can also be utilized.

Although the use of positive electrostatic voltages is disclosed herein, in some arrangements, negative electrostatic voltages may be more advantageous when overcoming particular defects.

Application angles other than 45° may be useful in conjunction with 'polar charge assist' in accordance with the present invention. In particular, forward application angles lying in the range of 20° to 60° may be useful.

I claim:

1. A method of curtain coating a composition on to a moving support in which maximum practical coating speed is increased, whereby a composition is applied to a moving support by curtain coating at a coating point, and an electrostatic voltage is applied to the support either prior to the coating point or at the coating point, said voltage being applied during the curtain coating process, the ratio of the electrostatic voltage at any point on the support to speed of said moving support being less than 1:1, the voltage being expressed in V and the speed of the moving support in $cms^{-1}$.

2. A method of curtain coating a composition on to a support according to claim 1 in which the maximum practical coating speed is increased, the method being characterized by the application of an electrostatic voltage to the support which is less than 500 V.

3. A method according to claim 2, wherein the electrostatic voltage is less than 400 V.

4. A method according to claim 1, wherein the electrostatic voltage is generated by inducing a polar charge on the support to be coated.

5. A method according to claim 4, wherein the polar charge is generated using corona techniques.

6. A method according to claim 4, wherein the polar charge is generated using a bristle brush arrangement.

7. A method according to claim 1, wherein the electrostatic voltage is generated using a charged coating roller.

8. A method according to claim 7, wherein the composition is coated on to the support at a forward application angle lying in the range of 20° to 60°.

9. A method according to claim 8, wherein the forward application angle is 45°.

10. A method according to claim 1 wherein the support is coated with a photographic coating layer.

* * * * *